US007901546B2

(12) United States Patent
Miller et al.

(10) Patent No.: US 7,901,546 B2
(45) Date of Patent: Mar. 8, 2011

(54) MONITORING METHODS, SYSTEMS AND APPARATUS FOR VALIDATING THE OPERATION OF A CURRENT INTERRUPTER USED IN CATHODIC PROTECTION

(75) Inventors: Melvin C. Miller, Vero Beach, FL (US); Marcelo Jakubzick, Sebastian, FL (US); Juan Pablo Gutierrez, Zapopan (ME)

(73) Assignee: M.C. Miller Co., Sebastian, FL (US)

( * ) Notice: Subject to any disclaimer, the term of this patent is extended or adjusted under 35 U.S.C. 154(b) by 476 days.

(21) Appl. No.: 12/075,957

(22) Filed: Mar. 14, 2008

(65) Prior Publication Data

US 2009/0229973 A1 Sep. 17, 2009

(51) Int. Cl.
*C23F 13/22* (2006.01)

(52) U.S. Cl. ..... 204/196.36; 204/196.37; 204/196.02; 204/96.03; 204/196.04; 204/196.05; 204/196.06; 204/196.07; 204/196.11; 204/196.26; 205/725; 205/726; 205/727; 205/728; 205/730; 205/740; 340/870.03; 340/870.06; 340/870.07; 340/870.09; 340/870.11; 340/870.13; 340/870.14; 340/870.15; 340/870.16; 340/870.19; 340/870.21; 340/870.24; 324/119; 324/120; 324/72; 324/691; 324/700; 324/713; 702/33; 702/64; 702/188; 327/530; 327/531; 327/533; 327/548; 361/18; 361/115

(58) Field of Classification Search ..... 204/196.36, 204/196.37, 196.02, 196.03, 196.04, 196.05, 204/196.06, 196.07, 196.11, 196.26; 205/725, 205/726, 727, 728, 729, 730, 740; 340/870.03, 340/870.06, 870.07, 870.09, 870.11, 870.13–870.16, 340/870.19, 870.21, 870.24; 324/119, 120, 324/72, 691, 693, 700, 713; 702/33, 64, 702/188; 327/530, 531, 533, 548; 361/18, 361/115

See application file for complete search history.

(56) References Cited

U.S. PATENT DOCUMENTS

| | | | | |
|---|---|---|---|---|
| 2,862,177 | A | 11/1958 | Titterington | |
| 2,947,679 | A | 8/1960 | Schaschl et al. | |
| 3,314,874 | A | 4/1967 | Flournoy | |
| 3,354,063 | A | 11/1967 | Shutt | |
| 3,364,422 | A | 1/1968 | Heuze | |
| 3,959,664 | A | 5/1976 | Kosoegawa et al. | |
| 3,990,478 | A | 11/1976 | McFarland | |
| 4,051,436 | A | 9/1977 | Weir, Jr. | |
| 4,058,428 | A | 11/1977 | Case et al. | |
| 4,133,734 | A | 1/1979 | Polak et al. | |
| 4,338,044 | A | 7/1982 | Titus | |
| 4,356,444 | A | 10/1982 | Saenz, Jr. | |
| 4,370,211 | A | 1/1983 | Hybler | |
| 4,414,511 | A | 11/1983 | Waits et al. | |
| 4,481,474 | A | 11/1984 | Gerrit | |
| 4,692,231 | A | 9/1987 | St. Onge | |
| 4,900,410 | A | 2/1990 | Bennett et al. | |
| 4,909,669 | A | 3/1990 | Baker | |
| 5,133,081 | A | 7/1992 | Mayo | |
| 5,210,482 | A | 5/1993 | Deeds et al. | |
| 5,290,407 | A | 3/1994 | Syrett et al. | |
| 5,306,414 | A | 4/1994 | Glass et al. | |
| 5,325,047 | A * | 6/1994 | Kempton | 324/72 |
| 5,339,911 | A | 8/1994 | Whited et al. | |
| 5,350,494 | A | 9/1994 | Brummelhuis | |
| 5,370,783 | A | 12/1994 | Carlson et al. | |
| 5,432,453 | A | 7/1995 | Dornauf et al. | |
| 5,469,048 | A | 11/1995 | Donohue | |
| 5,639,358 | A | 6/1997 | Bennett et al. | |
| 5,712,559 | A | 1/1998 | Moore et al. | |
| 5,713,392 | A | 2/1998 | O'Rourke | |
| 5,785,842 | A | 7/1998 | Speck | |
| 5,814,982 | A | 9/1998 | Thompson et al. | |
| 5,897,755 | A | 4/1999 | Star et al. | |
| 5,999,107 | A * | 12/1999 | Cooper et al. | 340/870.16 |
| 6,060,877 | A | 5/2000 | Nekoksa | |
| 6,107,811 | A | 8/2000 | Caudill et al. | |
| 6,187,161 | B1 | 2/2001 | Bushman et al. | |
| 6,238,545 | B1 | 5/2001 | Allebach et al. | |
| 6,315,876 | B1 | 11/2001 | Delahoyde et al. | |
| 6,625,570 | B2 * | 9/2003 | Pierro et al. | 702/188 |
| 6,646,427 | B2 | 11/2003 | Trejo et al. | |
| 6,744,265 | B2 | 6/2004 | Yunovich et al. | |
| 6,835,291 | B2 | 12/2004 | Hudson | |
| 7,081,187 | B1 | 7/2006 | Schutt | |
| 7,317,321 | B2 * | 1/2008 | Hilleary | 324/700 |
| 7,328,724 | B2 | 2/2008 | Britton | |
| 7,329,336 | B2 | 2/2008 | Britton | |
| 2001/0047247 | A1 * | 11/2001 | Flatt et al. | 702/64 |
| 2003/0169058 | A1 | 9/2003 | Pierre et al. | |
| 2006/0070871 | A1 | 4/2006 | Bushman et al. | |
| 2006/0203411 | A1 * | 9/2006 | Fourie et al. | 361/115 |
| 2007/0158184 | A1 | 7/2007 | Benham | |
| 2008/0204274 | A1 * | 8/2008 | Peters | 340/870.07 |

* cited by examiner

*Primary Examiner* — Bruce F Bell

(74) *Attorney, Agent, or Firm* — Marcus N. DiBuduo; Mark D. Miller

(57) ABSTRACT

The present invention includes systems, methods and apparatus for continuously, independently and in some cases remotely monitoring the operation of a current interrupter used to test a cathodic protection system, or the cathodic protection system itself, for verification of proper operation. Embodiments of the invention include electronic devices that may be temporarily attached to a current interrupter that is being used to test a cathodic protection system, or directly to the cathodic protection system itself. Embodiments of the invention monitor the activity of an interrupter by sampling the output (voltage and time) to identify the cycle(s) of the interrupter. The invention provides truly independent verification since it does not need to know in advance the sequence or cycle times of the current interrupter being monitored. The information obtained by the invention is output so that it may be provided to a user, displayed, downloaded or stored for future reference.

27 Claims, 5 Drawing Sheets

MONITORING METHODS, SYSTEMS AND APPARATUS FOR VALIDATING THE OPERATION OF A CURRENT INTERRUPTER USED IN CATHODIC PROTECTION

BACKGROUND OF THE INVENTION

1. Field of Invention

The present invention relates to current interrupter operations used in cathodic protection of metallic structures such as pipe lines, and more particularly to truly independent remote monitoring methods, systems and apparatus for validating the operation of such interrupters.

2. Description of the Prior Art

In a typical setting, buried steel structures such as pipelines for oil and gas have permanent cathodic protection provided by connecting the output of a DC voltage source to the structure (pipeline) and to ground. Tests of the state of cathodic protection must be made regularly, preferably at least once a year, to determine the effectiveness of the cathodic protection along the structure. In order to perform such tests, a current interrupter device is introduced. This device cyclically interrupts the cathodic protection provided by the voltage source that protects, for example, a stretch of a pipeline structure. The cycled interruption is generally scheduled to occur during the day so that testing may be performed. At night, the cathodic protection is ordinarily left "on" by programming the current interrupter accordingly. Any suitable interruption cycle may be employed, for example, the current may be left "on" in cycles that are 3 times longer than the "off" cycles, and these cycle times may run, for example, from one to ten seconds. The interruption cycles during the day allow a crew of test operators to walk along the buried structure (pipeline) with specialized data gathering equipment to perform required tests. Once a current interrupter is installed, it will ordinarily remain in place for several days adjacent to the voltage source (such as a rectifier) while test operators make measurements along the pipeline far away from the source.

Constant monitoring of the current interrupter operations is important, because a malfunction of a current interrupter may invalidate any testing performed during the malfunction. Without monitoring the current interrupter, test operators working away from the source may later discover that the system was not working properly, potentially wasting and invalidating several hours or even days of testing activity, and leaving the structures unprotected during that time.

One system that monitors the operation of a current interrupter is disclosed in U.S. Pat. No. 6,625,570. However, this patent discloses complicated complete replacement systems that not only control the voltage source, but also require prior knowledge of the cycle times. Such systems are impractical and expensive, requiring a user having an existing cathodic protection system to buy a whole new system.

There are several types of DC (direct current) power sources used in cathodic protection systems, the majority of which are rectifiers for use with AC (alternating current) power line power. Others include solar panels having DC outputs where a rectifier may control the amount of DC voltage and current that is output to the structure. Another example is a thermal electric DC used, for example, where a natural gas pipeline has no access to solar or the AC power grid. In these cases, a natural gas company may use some of the gas to heat/run a thermal electric generator. This derived DC voltage and current for cathodic protection may be controlled by a rectifier and must be tested, interrupted as described above. Other examples of cathodic protection systems that may be interrupted and tested include sacrificial anodes, and bonds between pipelines. In the cathodic protection regulations, all current sources that may be influencing the structure to soil measurement must be interrupted to insure proper on and off cathodic protection voltage readings.

It is therefore desirable to provide monitoring methods, systems and apparatus for use in cathodic protection systems to verify the operation of current interrupters used during periodic testing that may be temporarily installed or used with a wide variety of current interrupter systems regardless of the sequence or cycle times used by the systems, thereby providing a truly independent verification of the testing of the cathodic protection system, or verification of the operation of the cathodic protection system itself.

SUMMARY OF THE INVENTION

The present invention includes systems, methods and apparatus for independently and remotely monitoring the correct operation of a current interrupter used to test a cathodic protection system, or the cathodic protection system itself. Embodiments of apparatus of the invention include electronic devices that may be temporarily attached to a current interrupter that is being used to test a cathodic protection system, or directly to the cathodic protection system itself. Embodiments of these devices monitor the activity of an interrupter by sampling the output (voltage and time) to identify the cycle(s) of the interrupter, as well as the net resultant voltage magnitudes actually going to the structures being protected.

This information is then output so that it may be provided to a user, displayed, downloaded, stored, etc. There are several different places/ways that devices of the present invention may be attached to an interrupter or to a cathodic protection system, depending on the type of system used and what testing information is desired. In some embodiments, the user may set high/low voltage levels or other alarm conditions in the devices to indicate whether the cathodic protection system itself is working.

Embodiments of the invention detect the resulting current and voltage that goes to the buried structure (pipeline) when a current interrupter is operating, process the information in real time, and report the results. The results may be provided locally or to a remote location by any suitable means so that a user may ultimately review the information to validate operations. Embodiments of the invention are capable of reporting activity status, such as whether the cathodic protection system is cycling or in a steady state; and, if the voltage magnitudes are known, whether the system is "on" or "off."

Embodiments of the invention are also capable of reporting the specific "on" and "off" cycle times and their respective current and voltage magnitudes. The continuous output from the devices of the invention may be saved/stored for later confirmation or comparison. The devices monitor whether the interrupter is working properly during periodic testing of a cathodic protection system, and may also be used to confirm the operation of the cathodic protection system itself.

The present invention is unique in that the systems, methods and apparatus are independent of any combination of DC power source (e.g., a rectifier) and current interrupter, and will work on any cathodic protection system where a current interrupt is used to turn on and off the current sources. The invention can detect proper operation without knowing the cycle times of the interrupter or the sequence(s) in which they are applied. The invention can validate operations even when no operator is present, and is capable of 24 hour automatic monitoring of the operation of the interrupter and/or cathodic protection system. If the invention detects a change in status or a user defined alarm is triggered, the invention provides an alert (phone, e-mail, etc.) to operators of the system.

The invention also includes related methods of use. Typically a voltage source (such as a rectifier) provides cathodic protection to a buried structure. Then when the cathodic protection system needs to be tested, a current interrupter is introduced which cycles the protection voltage by interrupting the current flowing to the structure. The vast majority of existing current interrupters are not monitored, yet their operation affects the entire cathodic protection scheme while the interrupter is connected (both during and between testing intervals). The uniqueness of the present invention is that it does not know in advance the sequence or cycle times that the current interrupter is operating, therefore the invention provides a truly independent verification of the operation of the interrupter and of the cathodic protection system itself.

A typical embodiment of an apparatus of the invention includes an electronic module for connection to the cathodic protection system and/or interrupter to receive signals from the system, the module including an analog to digital converter for converting the input signals, an internal processor for cleaning, sampling and analyzing the input signals, and a communication module for outputting the results of the sampling and analysis. Embodiments of the invention are easily installed and operated, and may be provided in conveniently small sizes, and may be used for remote independent monitoring for the vast majority of existing systems in use that currently have not monitoring at all. In most embodiments, once the user installs the invention the status reporting is automatic.

It is therefore an object of the present invention to provide systems, methods and apparatus for truly independent monitoring and verification of the testing or operation of a cathodic protection system.

It is also an object of the present invention to provide systems, methods and apparatus for monitoring of the testing of a cathodic protection system that does not require prior information regarding cycle times or sequences of the testing equipment used to assure independent validation of proper operation.

It is also an object of the present invention to provide systems, methods and apparatus for providing continuous verification of the testing or operation of a cathodic protection system.

It is also an object of the present invention to provide systems, methods and apparatus for remote monitoring of the testing or operation of a cathodic protection system.

It is also an object of the present invention to provide simple systems, methods and apparatus for monitoring of the testing or operation of a cathodic protection system that are easy to install and operate, and may be used on a wide variety of cathodic protection systems and testing equipment.

It is also an object of the present invention to help prevent catastrophic loss from deterioration of buried structures from failure of cathodic protection systems or testing systems.

It is also an object of the present invention to help prevent undetected failure of cathodic protection or testing systems.

It is also an object of the present invention to save time and prevent unnecessary repetition of testing of cathodic protection systems caused by failures in the testing systems.

Additional objects of the invention will be apparent from the detailed descriptions and the claims herein.

REFERENCE NUMERALS AND DRAWINGS

Figure 1:
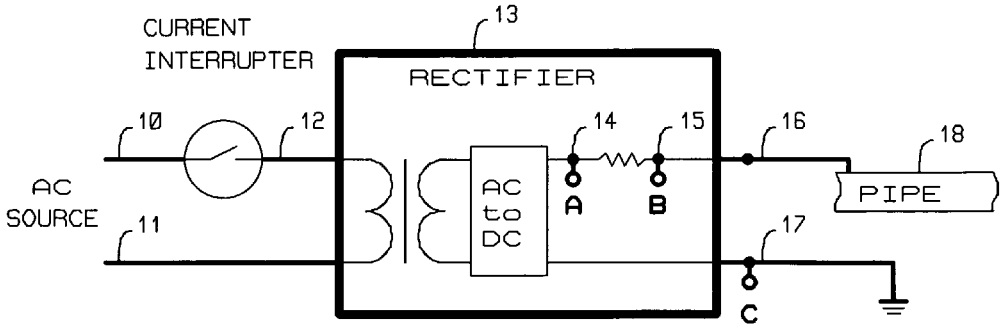
FIG. 1 is a schematic of an exemplary embodiment of testing equipment (current interrupter) of a cathodic protection system on an alternating current (AC) line showing points A, B and C for potential connection to an embodiment of a device of the present invention.

Set forth below are identifications of the reference numerals and characters used in the accompanying drawings.

FIG. 1:

10—The first of two AC power source points to a cathodic protection system.

11—The second of two AC power source points to a cathodic protection system.

12—AC power source point controlled by the current interrupter testing equipment.

13—Rectifier. It is to be appreciated that any DC power source may also be used including without limitation solar, thermal, batteries, etc.

14—Contact point A, for connection to an embodiment of the present invention.

15—Contact point B, for connection to an embodiment of the present invention.

16—First of two DC power outputs; this is also where a buried structure (such as a pipeline) connects to the cathodic protection system.

17—Second of two DC power outputs and contact point C; this is also where the earth (ground) is tied to the cathodic protection system.

18—A structure (e.g. pipeline) buried in the earth and protected by the cathodic protection system.

FIG. 2:

20—Contact point A (current sense), current input to an embodiment of the invention.

21—Contact point B (common), zero voltage input to an embodiment of the invention.

22—Contact point C (voltage sense), voltage input to an embodiment of the invention.

Figure 2:
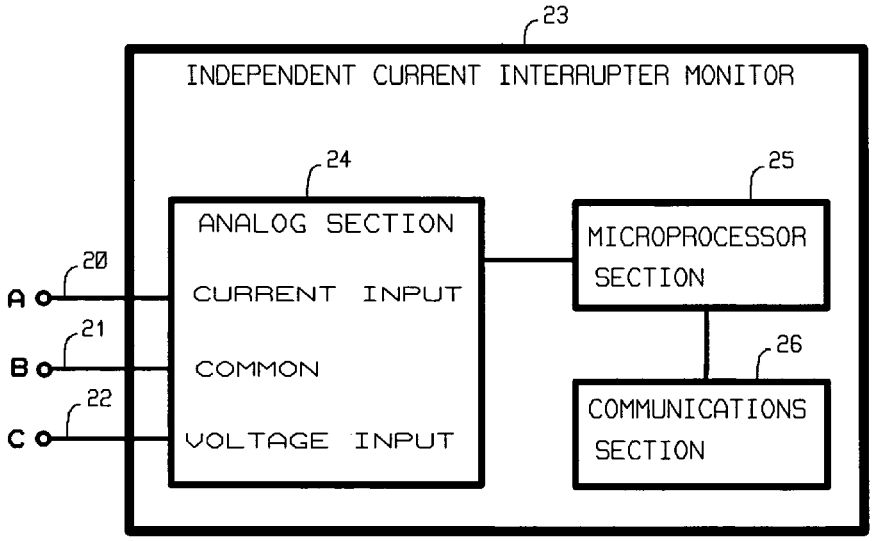
FIG. 2 is a block diagram illustrating components of an embodiment of an apparatus of the present invention.

23—An embodiment of the invention. This block depicts the hardware top level components of a preferred embodiment of the invention. FIG. 2 illustrates 3 points of contact with an existing cathodic protection system.

Embodiments of the invention may be powered using batteries, or power may be drawn from points B and C, or from another independent source.

24—Analog section. In some embodiments of the invention, this section may contain spike protectors, analog filters, operational amplifiers, and/or an analog-to-digital (A-to-D) converter system to translate a voltage level to digital numbers for further handling by a Microprocessor.

25—Microprocessor section. In some embodiments of the invention, this section may contain an actual microprocessor(s), RAM, ROM and EEPROM Memory and/or glue logic. The implementation of some of the methods of the present invention may be embedded in firmware contained in the ROM/EEPROM section of the microprocessor. A more complete description of programming and processes performed on the incoming signals is provided below with reference to FIG. 5 and in the detailed description.

26—Communications section. In some embodiments of the invention, this section may contain a communications interface to the user. In some embodiments, this may be provided in the form of a printed circuit board (PCB) containing a satellite transmitter module and antenna with a serial interface with the microprocessor section; in such embodiments, the microprocessor section may send the information to the communications section, and from there it may be sent to a satellite (low orbit), it then may be sent to the internet, and finally it may be sent to a intended user via email. In other embodiments, other communications interface(s) may be used, depending on the user preference, such as and without limitation cellular phone modules, bluetooth radios, RS482, RS232, wired serial communications, and the like. In a preferred embodiment, LEO satellite communication is used; however, by changing only the radio, antenna and communication protocol it is possible to communicate with any satellite system, cellular system, bluetooth system, radio system, paging system, or other wired or wireless system.

FIG. 3:

30—The first of two AC power source points to a cathodic protection system.

31—The second of two AC power source points to a cathodic protection system.

33—Rectifier. It is to be appreciated that any DC power source may also be used including without limitation solar, thermal, batteries, etc.

34—Contact point A, for connection to an embodiment of the present invention.

35—Contact point B, for connection to an embodiment of the present invention.

Figure 3:
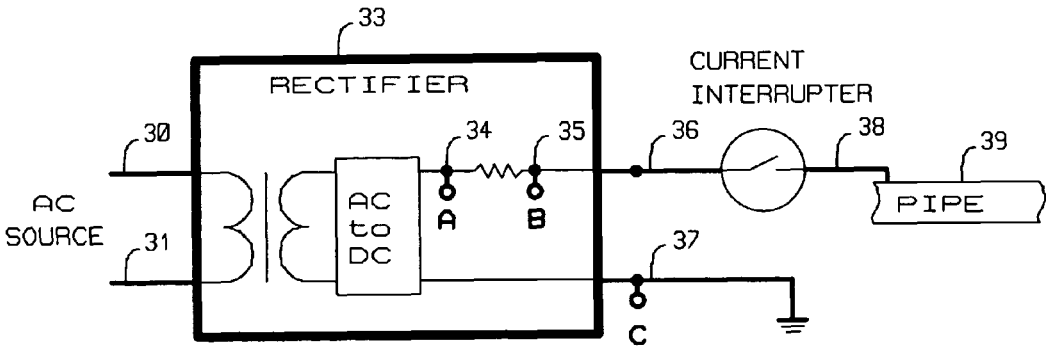
FIG. 3 is a schematic of an exemplary embodiment of testing equipment (current interrupter) of a cathodic protection system on an direct current (DC) line showing points A, B and C for potential connection to an embodiment of a device of the present invention. In this illustration, the C point monitors the voltage before the current interrupter.

36—First of two DC power outputs; in the exemplary embodiment of FIG. 3, this is also one of the points where a current interrupter was inserted.

37—Second of two DC power outputs and contact point C; in the exemplary embodiment of FIG. 3, this is also where the earth (ground) is tied to the cathodic protection system.

38—in the exemplary embodiment of FIG. 3, where the buried structure (pipeline) connects to the cathodic protection system.

39—A structure (e.g. a pipeline) buried in the earth and protected by the cathodic protection system.

FIG. 4:

40—The first of two AC power source points to a cathodic protection system.

41—The second of two AC power source points to a cathodic protection system.

42—Rectifier. It is to be appreciated that any DC power source may also be used including without limitation solar, thermal, batteries, etc.

43—First of two DC power outputs. In the exemplary embodiment of FIG. 4, this is also one of the points where a current interrupter was inserted.

Figure 4:
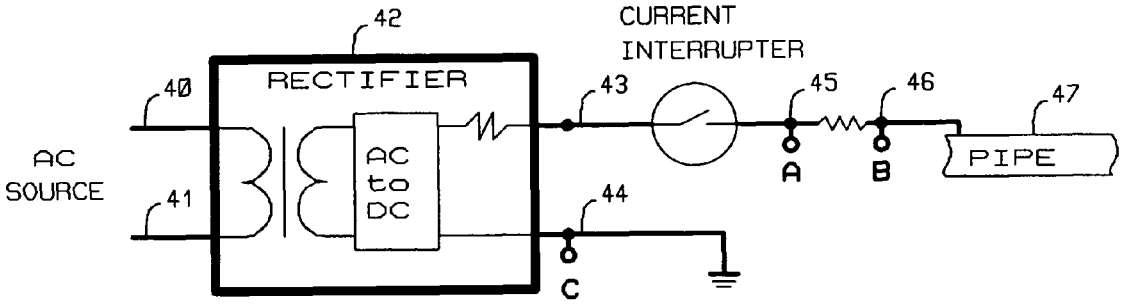
FIG. 4 is a schematic of an exemplary embodiment of testing equipment (current interrupter) of a cathodic protection system on an direct current (DC) line showing points A, B and C for potential connection to an embodiment of a device of the present invention. In this illustration, points A, B and C monitor the voltage and current after the current interrupter

44—Second of two DC power outputs and contact point C; in the exemplary embodiment of FIG. 4, this is also where the earth (ground) is tied to the cathodic protection system.

45—Contact point A, for connection to an embodiment of the present invention.

46—Contact point B, for connection to an embodiment of the present invention. In the exemplary embodiment of FIG. 4, this is also where a buried structure (such as a pipeline) connects to the cathodic protection system.

47—A structure (e.g. a pipeline) buried in the earth and protected by the cathodic protection system.

FIG. 5:

50—Contact point A (current sense), current input to an embodiment of the invention.

51—Contact point B (common), zero voltage input to an embodiment of the invention.

52—Contact point C (voltage sense), voltage input to an embodiment of the invention.

53—Voltage/time graph illustrating a possible appearance of an exemplary input signal. This example shows a sample of a voltage signal that may be detected between input points A and B, or between input points B and C.

54—Voltage/time graph representing a possible appearance of an input signal after having been converted from analog to digital. (Although the illustration looks basically the same as the input stage 53, the actual signals are digital numbers at this point—but little has changed as to their illustrated appearance.)

55—Voltage/time graph representing a possible appearance of an input signal after they have being digitally cleaned. The AC line frequency components and most of the noise have being eliminated from the original signal in this illustration such that mostly discrete and useful values remain. At this point, it is now numerically possible to begin the process of determining cycle times and magnitudes.

56—This is a graphic representation of exemplary numerical values from stage 55, illustrating exemplary on/off times (TON/TOFF) and voltages (VON/VOFF) from the exemplary cycles generated by the interrupter. At this stage, embodiments of the invention are capable of determining cycling status, timing and/or magnitude parameters based on the values obtained. Any of these values (TOFF, TON, cycling, non-cycling, etc.) may be compared with user parameters or user defined thresholds to determine whether status alarms need to be activated. For example, one or more of the following basic alarms, in addition to others, may be established:

Status Change: this alarm may be triggered when status changes from cycling to steady or vice versa.

Low Battery: this alarm may be triggered when battery goes from medium to the lowest indication. Battery status may be transmitted as part of the reporting, but only triggers an alarm when the lowest level is reached.

Figure 7:
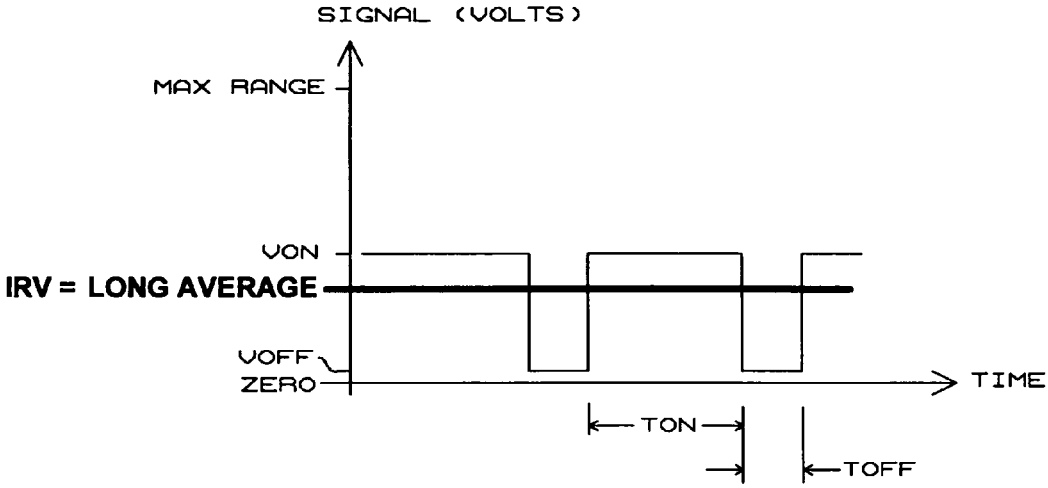
FIG. 7 contains two graphic illustrations of exemplary signals. The upper graph is an exemplary cycling signal; the lower graph illustrates exemplary user thresholds.
Figure 7:
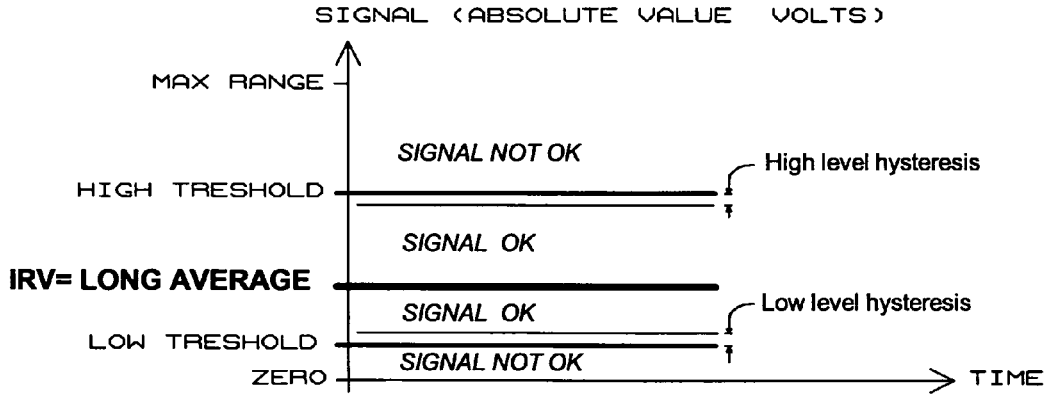

Outside Acceptable (Threshold) Level: this alarm may be triggered when the long term average value of the current and/or voltage is outside a pre-defined range of acceptability. (See detailed description, and discussion of FIG. 7 below.)

57—This is a graphic representation of an exemplary display of information from stage 56. At this stage, embodiments of the invention are capable of sending the information to the communications module 26. The sequence of how often and what data is to be sent may be computed at stage 56 based on user parameters.

FIG. 6:

60—Contact point A (current sense), current input to an embodiment of the invention.

61—Contact point B (common), zero voltage input to an embodiment of the invention.

62—Contact point C (voltage sense), voltage input to an embodiment of the invention.

Figure 6:
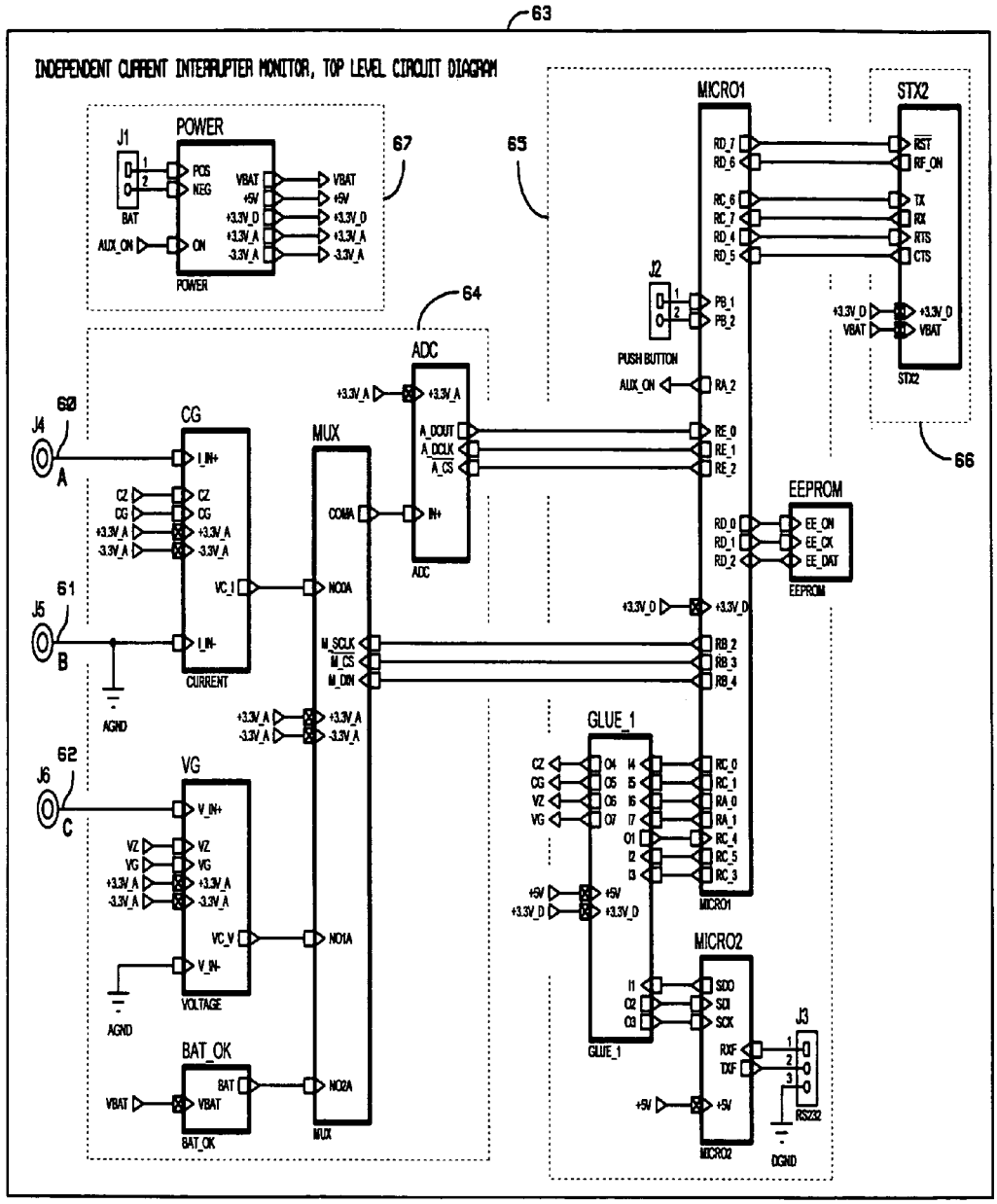
FIG. 6 is an electrical circuit diagram of an embodiment of the invention using the connectivity illustrated in FIG. 2.

63—An exemplary embodiment of the invention. This block depicts an example of an embodiment of a top level electrical circuit of a preferred embodiment of the invention. FIG. 6 illustrates 3 points of contact with an existing cathodic protection system. Embodiments of the invention may be powered using batteries, or power may be drawn from points A and B, or from another independent source (which would change the inputs to the illustrated "power" module 67).

64—Analog section. In the exemplary embodiment of the invention illustrated in FIG. 6, this section contains:

A differential amplifier (Current Gain (CG) module) for the current sensor input having inputs to self calibrate the zero volts value and to control the gain. The input also has spike protection. Any suitable input range may be used such as, without limitation, +/−600 mv, +/−60 mv, +/−6 mv, etc. in order to cover positive or negative voltages over an appropriate range for a particular cathodic protection system application.

An equivalent differential amplifier circuit (Voltage Gain (VG) module) for the voltage sensor input having inputs to self calibrate the zero volts value and to control the gain. The input also has spike protection. Any suitable input range may be used such as, without limitation, +/−400 v, +/−60 v, etc. in order to cover positive or negative voltages over an appropriate range for a particular cathodic protection system application.

A battery sensor (BAT_OK module) to sense the battery so that the user may be alerted when battery power is low.

A multiplexor (MUX module) for the current, voltage and battery inputs from the CG, VG and BAT_OK modules.

An analog-to-digital converter (ADC), which may be 16-bit, or other suitable size.

65—Microprocessor section. In the exemplary embodiment of the invention illustrated in FIG. 6, this section contains two microprocessors and other components:

MICRO1 is the main processor that does the signal processing and sends the results to the communications channel. It also saves any key user parameters and alarm in the EEPROM permanent memory module. The implementation of the methods described herein are embedded in the firmware provided here.

MICRO2 is a secondary processor that includes an LCD module for instant display of information while in the field. MICRO2 also handles the communications necessary to store the user parameters in MICRO1. This may include serial communications to and from the user PC at RS232 levels.

An on/off switch (PUSH BUTTON) connector is used for convenience to turn the invention on or off for transport.

Digital level shifters (GLUEL_1) interface the microprocessor with the rest of the circuits. These devices allow the connection of the two different operating main voltages, 3.3 v for MICRO 1, and 5.0 v for MICRO 2, as well as serving as buffers for the circuit connections that may have their power turned "on" and "off" at different times.

66—Communications section. In the exemplary embodiment of the invention illustrated in FIG. 6, this section contains an exemplary satellite communications module STX2. Inside STX2 is the power supply for a transmitter, using VBAT as the power source, and glue logic. This section sends the final information to the user. It is to be appreciated that in other embodiments, other communications interface(s) may be used, depending on the user preference, such as and without limitation cellular phone modules, bluetooh radios, RS482, RS232, wired serial communications, and the like.

67—Power source circuit. In the exemplary embodiment of the invention illustrated in FIG. 6, this section provides power for all components. Starting with a set of batteries, the switching and linear regulators in the POWER module provide the necessary voltage to power all components.

Source VBAT may be both a signal that provides the means to determine if the battery source is near depletion, and also the source of raw power for the transmitter section of the exemplary communications module STX2.

Source +5V provides power to MICRO2.

Source +3.3V_D is a +3.3 volts source for the Digital part of the system.

Source +3.3V_A is a +3.3 volts source for the positive analog part of the system.

Source −3.3V_A is a −3.3 volts source for the negative analog part of the system.

Note that the AGND and DGND grounds are tied to a common point and to the negative side of the battery, J1 pin 2, and are implicit through the entire illustrated embodiment.

Input AUX_ON helps the illustrated embodiment conserve power by shutting down all but the necessary power to MICRO1 during transport.

FIG. 7:

This figure contains two graphic/pictorial representations of examples of threshold voltage levels and their meanings that allow a user to properly configure a threshold alarm. The upper illustration also shows an initial reference value (IRV), and a typical sanitized cycling wave form. The lower illustration could be for a cycling or for a steady signal.

DETAILED DESCRIPTION

Referring to the drawings wherein like reference characters designate like or corresponding parts throughout the several views, and referring particularly to FIGS. 1, 3 and 4 it is seen that a pipeline or other structure 18, 39, 47 has been partially or fully buried in the earth and has been provided with a cathodic protection system. It is to be appreciated that DC power is provided to the buried structure, which may come through a rectifier 13 attached to an AC power source, or from any other suitable DC power source including without limitation solar, thermal, batteries, etc. In a cathodic protection system, such as the one illustrated in FIG. 1, there are 3 points of contact, A (14), B (15), and C (17). Contact points A (14) and B (15) are ordinarily provided on either side of a shunt (resistor) provided on the DC power output line (in this case, coming out of a rectifier 13) where a small voltage is developed as current passes through it. In the illustrated embodiment, the line containing contact points A (14) and B (15) leads from the DC power source (e.g., rectifier 13) to the protected structure, which is a pipeline in this illustration. The current through this line is controlled (turned on or off) by the current interrupter and it flows through the shunt to protect the structure. The shunt is provided so the when the DC power source is turned off, the current going through it can be verified at that point. This is a basic verification that the DC power source is sourcing current, that it has been connected properly and it is not open. This is also a basic installation check to determine that the rectifier setting is correct with respect to the load represented by the structure, that the right amount of current is present. This verification is typically done with voltmeter by the person installing the testing and monitoring equipment. It is to be appreciated that the current interrupter may be provided in series ahead of the rectifier (FIG. 1), ahead of contact points A and B (FIG. 4), or after contact points A and B (FIG. 3) without changing the operation of the invention which is always connected to the output of the DC power source. In FIG. 4, an additional shunt was added between points 45 and 46 in order to facilitate monitoring by the present invention.

An apparatus of the present invention, such as the exemplary embodiment illustrated in FIG. 2, is electrically attached to the cathodic protection system. In some embodiments, the apparatus may be provided in a small self-contained box that may measure, for example, approximately 7 inches by 5 inches by 3 inches in size. Such a box contains all the elements of FIG. 2, also described in circuit form in FIG. 6. The illustrated apparatus is connected to the cathodic protection system (with or without a current interrupter) at points A, B and C. In particular, point A (14) of FIG. 1 is connected to point A (20) of FIG. 2; point B (15) of FIG. 1 is connected to point B (21) of FIG. 2; and point C (17) of FIG. 1 is connected to point C (22) of FIG. 2. This may be accomplished using three separate wires, a 3-wire cable, etc.

Figure 5:
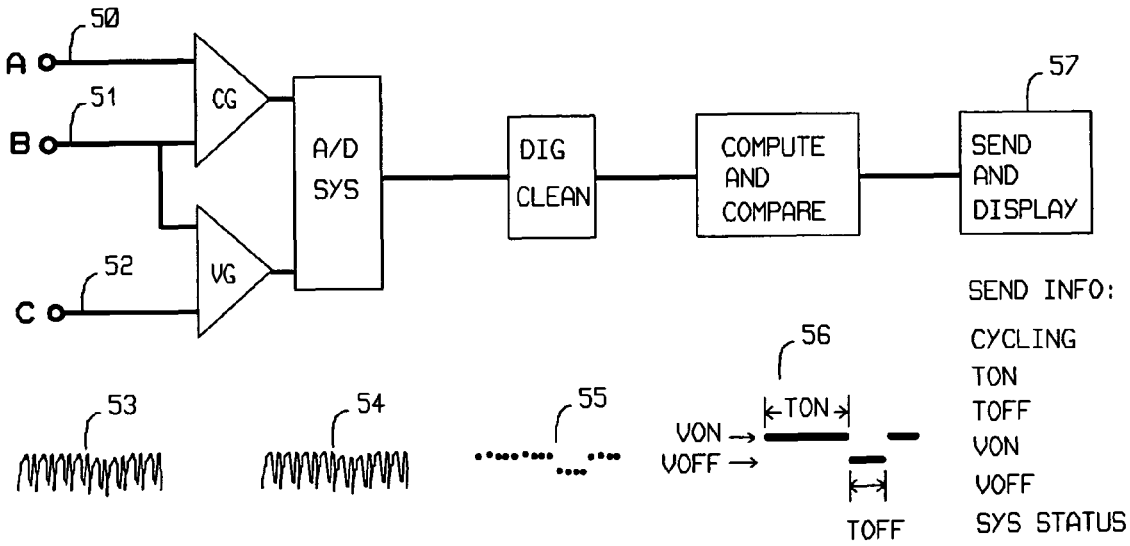
FIG. 5 illustrates steps of an exemplary embodiment of the method of the invention. The upper portion of this illustration is a graphical representation of process blocks as a signal travels through an embodiment of the invention; the lower portion shows a corresponding chronology providing figurative illustrations of an exemplary signal at each of the steps.

It is to be appreciated that contact points A (20), B (21) and C (22) of FIG. 2 are the same as or correspond to contact points A (50, 60), B (51, 61) and C (52, 62) of FIGS. 5 and 6. It is also to be appreciated that all of the embodiments of the present invention, including without limitation those of FIGS. 2, 5 and/or 6, may be connected to any of a wide variety of embodiments of cathodic protection systems and testing equipment, including without limitation those illustrated in FIGS. 1, 3 and/or 4, using the same contact points A, B and C.

The invention may be hooked to the current (using the existing shunt or adding one to measure the current voltage); and/or to the voltage (voltage delta points at the structure—where it will detect cycling, as in FIG. 1 or FIG. 4); or before the current interrupter (where the voltage will be steady, as in FIG. 3). The invention will monitors whatever it is hooked up to. The user may select which hook up determines the cycling status. A current hook up is preferred because it will always indicate cycling conditions no matter what the set up is. In either case, the invention will monitor and analyze all available parameters for the selected hook up, one just has to be chosen to determine the status.

The user may configure the invention (setting parameters to establish thresholds, set alarms, etc.) based on the hook up selected. The user may also determine how he/she wants to receive the results from the invention (e-mail, telephone, text message, etc.). In the case of email, the user may have a PC program that further process the results, etc. Typical user parameters may include:

1. Line Source Frequency: 50 or 60 Hz. With the exception of about 9 countries (that have 50 on one region and 60 on another) most countries have one or the other, not both. Selecting the line frequency is an added bonus to cleaning the signal to its optimum level. For example, in the United States, the line frequency is 60 Hz, and all the power used derives from this frequency.

2. Select alarm(s) to be activated, including without limitation:
   - Alarm when battery is low;
   - Alarm when status changes (cycling to steady or vice versa);
   - Alarm for going above or below threshold level(s). Each Signal will have its own threshold level(s)
   - Additional alarms may also be established such as monitoring the cycling period to determine whether it is what is expected, etc.

3. Select parameters for the processor and related components including, without limitation:
   - establish the channel to be is used for computing cycling status
   - establish ranges to be used for the current (A to B) and voltage (B to C) inputs
     - Example ranges for current: +/−600 mv, +/−60 mv, +/−6 mv, etc.
     - Example ranges for voltage: +/400 v, +/−60 v, etc.
   - determine whether or not to sample continuously, and whether or not to sample both a selected status channel (e.g. current) and/or an alternative channel (e.g. voltage). For example, continuous sampling of the selected channel and sampling of the other channel at 10 second intervals may be selected.
   - determine whether to activate or deactivate specific alarms, to control the maximum number of alarms per day per alarm, etc.

Depending on the desires of the user, embodiments of the invention may be configured to provide a display or readout of the information obtained by the invention regarding the operation of the cathodic protection or testing system, and/or this information may be set up to be transmitted via wired or wireless means to another location, or downloaded, stored or otherwise transferred. In many cases, the invention will transmit raw data to another location where a computer will receive and process the data, and store and/or display it according to the desires of the user at that location.

For exemplary purposes and without limiting the scope of the invention or the claims appended hereto, an example is set forth below of a selection of user input and threshold parameters. The voltage input is used in this example, but a corresponding procedure applies to the current input with changes to the magnitude(s). In this example, the user knows that the DC power source (e.g., rectifier) has been set to produce 6 volts. Based on this information, the user knows that in order for cathodic protection system to properly function, the LONG term AVERAGE ("LONG AVERAGE" in FIG. 7) should not be more than approximately 12 volts nor less than about 1 volt. If either of these thresholds is exceeded (more than 12 volts, or less than 1 volt), the user wants to know that it is happening because something is wrong. Referring to the lower graph of FIG. 7, in this example the user has selected 12 volts as the HIGH THRESHOLD and 1.0 volts as the LOW THRESHOLD. If the LONG AVERAGE crosses above 12 volts or below 1 volt, an alarm will be send to the user.

Referring to FIG. 5, element 56, in this example the VON is 6 volts and VOFF is 0.5 volts, and the cycle on time (TON) is 3 seconds and the cycle OFF time (TOFF) is 1 second. Then, the weighed LONG AVERAGE will be: $((6\times3)+(0.5\times1))/4=4.6$ volts, which is illustrated by the "long average" line in the upper and lower graphs of FIG. 7. Normally, the invention will be "on" during the night and cycling during the day.

Therefore, in this example, the minimum LONG AVERAGE voltage that one should see is 4.6 volts and the maximum should be 6 volts. The LONG AVERAGE may be used as a threshold value because it is the average taken over typically 3 minutes. The user may define a longer or shorter time, but a default of 3 minutes is usually adequate. Additional user defined alarms may include whether cycling is occurring or not, the number of alarms per 24 hour period, high and low level hysteresis, etc. The hysteresis parameter may be defaulted to zero. It is to be appreciated that additional or alternative user defined parameters may also be established for current monitoring with or independently of any voltage monitoring parameters.

In order to start the exemplary apparatus illustrated in FIG. 6, if the unit was previously put to sleep (such as for transportation from one place to another), the user presses the PUSH BUTTON to provide power. Normally, power is already there, so that the unit works 24/7 without stop. In some embodiments, batteries are used to provide power, and placed inside the encasement. Installation of batteries is desirable before connecting the unit to the system. The user-definable parameters are then established (e.g. via a serial cable from a PC). A communication link is established, and the unit is connected to points A, B, C and left alone for 24/7 monitoring. After that, only replacing batteries will be necessary every few months unless the user wants to change program parameters. The unit is now operational and will operate automatically, providing 24-hour remote monitoring the operation of the current interrupter and/or the cathodic protection system. In some embodiments, in order to turn off the power, the user may need to depress the PUSH BUTTON for a period of time, in which case an LCD display inside MICRO2 (65) may alert the user that the unit is about to go off. Power may alternatively be taken with another circuit using points B and C.

The internal operation of the exemplary embodiment of FIG. 6 is explained below with reference to the corresponding exemplary graphic illustration of FIG. 5. These internal processes are automatic and implemented in the firmware. The operation of this firmware is described in the following detailed procedures of MICRO1, depicted in the microprocessor section 65 of FIG. 6.

In some embodiments, the unit may be turned on by momentarily pressing the PUSH BUTTON in microprocessor section 65 (after the unit has been previously asleep, such as during transportation), the MICRO1 in section 65 then enables the analog section 64 by turning on the AUX_ON pin. In other embodiments a single AUX_ON may control three separate power supplies, or there may be three AUX_ONs to control each individual power supply. In either case, the result is the same.

It is to be noted that in the case of the current signal, it is really a voltage value of the actual current flowing through the shunt. The shunt resistance rarely changes. A shunt is ordinarily attached to the rectifier or other cathodic protection DC power source, or may be provided by the user upon installation of the invention (see FIG. 4). For example, the shunt may have a marking of "75 A/50 mV" meaning that it has 0.66 mOhms of resistance. Assuming for the sake of example only, and without limitation, that the "on" current is one amp (1 A), therefore the voltage value as seen from the current input will be 1 A×0.66 m Ohms=0.66 mV (V=I*R) when the current is "on" and close to 0.0 mV when it is "off." This voltage is what is monitored by the invention. If the user desires to determine the actual current, the user may use a separate PC program and input this voltage and the value of the shunt at the DC power source location. The PC program may then compute the current value for the user.

To avoid mishandles, the ranges for current and voltage may be set at plus or minus a maximum value. For example, and without limitation, ranges for the current input to cover industry standards may be: +/−600 mV, +/−60 mv, +/−6 mv, with corresponding effective resolutions of 0.366 mV, 0.0366 mV, 0.00366 mV respectively. These are practical implementation ranges, but by no means the only limits that may be implemented. Taking the +/−60 mv range and using the 75 A/50 mV shunt allows effective measurement of a wide dynamic range delta current (the difference between "on" and "off" currents), of between about 0.05 Amp (effective resolution=0.0366 mV divided by shunt of 0.66 mOhms) and about 75 Amp. According to this example, whether the regular "on" is as little as 0.05 Amps (going to 0.00 Amp when "off") or if it is as much as 75 Amps (going to 0 Amps when "off"), the present invention will detect the status of cycling in spite of noise and wide range dynamic conditions. It is to be appreciated that as long as there is at least about 50 mA of difference between the "on" and "off" conditions, cycling can be detected. It is believed that this range should cover most applications in the field.

Similarly, and without limitation, ranges for the voltage input to cover industry standards may be: +/−400V, +/−60V, etc. with corresponding effective resolutions of, respectively, 0.22 volts and 0.036 volts. As above, once a range is established, as long as the difference between the "on" voltage and the "off" voltage is at least the effective resolution, then the cycling status may be computed correctly. Either of the ranges above is adequate for the vast majority of cases.

Signals coming from the DC power source (e.g., rectifier) of the cathodic protection system are received through contact points A, B and C. It is to be appreciated that such signals may be received from the cathodic protection system itself, with or without the testing equipment (current interrupter) installed. It is preferred that contact points A (14, 34, 45) and B (15, 35, 46) be provided on opposite sides of a shunt located on an output line leading from a rectifier 13, 33, 42 to the protected structure 18, 39, 47; and that contact point C (17, 37, 44) be located on the other output line from the rectifier leading to ground. It is also to be appreciated that the current interrupter may be provided in series ahead of the rectifier and contact points A and B (FIG. 1), after the rectifier but ahead of contact points A and B (FIG. 4—with added shunt), or after the rectifier and after contact points A and B (FIG. 3) without changing the operation of the invention.

Incoming signals from points A and B enter through hardware gain CG, and signals from points B and C enter VG, respectively, and then pass through the analog-to-digital converter (ADC) as shown in FIGS. 5 and 6. Referring to FIG. 6, the MICRO 1 controls the MUX on FIG. 6 to channel the current (after CG) or the voltage (after VG) signals, one at a time, to the AD converter to extract the digital number(s) that correspond to the analog input IN+ in the ADC module. B (51) is the ground reference, C (52) is the voltage input to the invention, just as A (50) is the current (actually it is the voltage across the shunt that represents the current) input to the invention. Each signal exiting the ADC is somewhat cleaner, but has the same characteristics as the original signal, only now it has been converted to numerical (digital) form. The signal graph still appears very similar to the original signal. Compare 53 to 54 in FIG. 5.

It is important to remove unnecessary noise from the signal in order for accurate analysis and comparison. This is accomplished in MICRO1 of 65. Each signal is cleaned of the fundamental and related AC line frequency coming from the AC source, and most other residual noises are also removed. The resultant values are depicted as discrete points corresponding to numerical results after the digital processing cleaning takes place. See points 55 of FIG. 5. The cleaning is accomplished by taking a large average of the exact number of samples that cancel out an exact multiple of the fundamental line frequency. These values are taken in precise equal increments of time. For example, 64 samples taken in 1/60 seconds at 0.264 ms intervals will cancel the effects of the line voltage for a country that uses 60 Hz, such as is the for the USA. Note that for the 64 samples there are 63 equal spaces between them.

Once the signal has been converted to a relatively clean digital form from the previous steps, the exemplary microprocessor section 65 and its embedded firmware determines whether the system is cycling or not and what the timing and voltage values are. Once these are determined, the system then checks for user preferences as to any thresholds for alarms and/or when and how often to alert the user on how the system is working.

The determination of the whether the signal to the pipeline is cycling or not (caused by the current interrupter) is accomplished in the processor (firmware) by taking an average value of the current or voltage over a given period of time. A default of 3 minutes is provided in some embodiments, which will compute a new reference every 3 minutes. The same process applies to either current or voltage. Normally the current is selected by the user to serve as the source of this determination, since in any setting, the current will always show variation. Then, using this average value as an Initial Reference Value (IRV), the processor then counts when consecutive samples are above it. An illustration of an IRV is shown in the top graph of FIG. 7 identified as LONG AVERAGE, which is another name for IRV. Once a given number of consecutive samples are found to be above this IRV reference (e.g., 3 of them, although any suitable number may be used), a first level reference is made, VON. See FIG. 5, element 56 and FIG. 7.

Once a VON has been established, the processor looks for a number of consecutive changes below the IRV reference (e.g., 3 of them, although any suitable number may be used). If found, these will constitute the VOFF condition. The start of the timing for counting the length of the "off" time begins at the first of these consecutive points below IRV. Once the TOFF interval has begun (VOFF time is being counted), the processor looks for a transition above IRV. When a given number of consecutive transitions above the IRV are made (e.g., 3 of them), the processor validates that the VON has started, and begins timing the TON from the first of the consecutive transitions. Then, the processor looks for a set of consecutive transitions below IRV, and so on. Once a pattern is established, a first cycle value set, with timing always beginning at the first transition, but only validated if consecutive ones also come. This process is repeated for consecutive cycle times (e.g. 2 more, although any suitable number may be used), and if the cycle times are the same (or within a tolerance of about 10% to about 16% to compensate for resolution and temporary noise factors), then the system is validated as cycling. It is to be appreciated that TON and TOFF (as well as VON and VOFF) merely represent different states, and that TON is ordinarily greater than TOFF (VON is ordinarily greater than VOFF), but these may be transposed if this is not the case.

Once in the cycling status, the processor continues validating by repeating the process of checking consecutive transitions against the IRV value described above. If the cycle times do not match to within about 12% for a given number of consecutive periods (e.g. 2 or 3, or more), this means the previous cycling has stopped, and the status would change to steady. This should also cause an alarm to be sent, if it was enabled by the user. In either status (cycling or steady) the processor will always compute all the time: if cycling, it will be validating the cycling; and if not cycling, it will be trying to establish the cycling parameters as indicated in the procedure above.

If after the time validation (2 or 3 or more time periods), the invention confirms that the interrupter attached to the cathodic protection system is cycling, the cycle period is TON+TOFF. The invention may then report the time for only the TON portion of the cycle, only the TOFF portion of the cycle, or the entire cycle, depending on the desires and settings from the user. During this process, the voltage values of each signal corresponding to the samples at any given time are also saved. Voltages during the "on" cycle are averaged together, and voltages during the "off" cycle are also averaged together. These average voltages are the VON and VOFF values 56 in FIG. 5, and may also be reported and/or stored according to the desires and settings of the user.

It is to be appreciated from the above discussion that it is not necessary for the invention to have prior information regarding the cycle times of the current interrupter.

In some embodiments, self imposed limits may be established to prevent waiting indefinitely for the next transition. Examples of such limits include, without limitation, limits for the cycle times of between about 0.4 seconds and about 20 seconds, with a resolution for the reported times at about 0.1 second. These limits and resolutions could be extended if necessary but these exemplary limits and resolutions are believed sufficient to cover most industry standards. The exemplary ranges for the voltage and current discussed above are also believed sufficient to cover most industry standards.

In some embodiments, in order to prevent false transition determinations, a minimum default change from the IRV may be implemented, such as range/8192. This is based on an estimated effective resolution of about 20 LSB (least significant bit) of the magnitude range, and an estimated minimum (not the same as IRV) delta signal around the IRV of about 4 LSB of the magnitude range. It is to be appreciated that these factors may be varied, and other factors may be taken into consideration in avoiding false transition determinations. For example, and without limitation, if the current input is in the 60 mv range (having a shunt of 75 A/50 mV (0.666 mOhm) and not cycling), then currents differing from the IRV by a magnitude of +/−11 mA (voltage of 0.0073 mV or less) will be considered noise, and will not be counted as transitions. Note that the 11 mA current is already sanitized, which means most of the noise has already been filtered. This scheme prevents false implication of cycling and has being tested under a wide variety of simulated real cases.

If no voltage/timing pattern is found, or if the pattern changes or stops, the invention will determine that the current interrupter is not cycling and will report this information.

In addition to the user receiving the status at regular intervals, the user may program one or more specific alarm conditions. For example in a 60 mV shunt range, the user may set up an alarm that if the average value of both VON and VOFF 56 is less than 2 mV, this may mean that the cathodic protection system itself is OFF. If such a condition is detected, the invention may be programmed by the user to report this information as an alarm via the communications module 66 that something is not working.

The information, analysis and alarms generated by the invention may be reported in a wide variety of ways, depending on the desires of the user and the communication equipment used. The output from the microprocessor section 65 is sent to the communications section 66 for output. Any suitable communications interface(s) may be used, depending on the user preference, such as and without limitation, satellite, pager, cellular phone, bluetooh, RS482, RS232, wired serial communications, and the like. The information may be stored for later analysis and/or comparison, and may also be displayed locally or remotely for review by the user. In the illustrated exemplary embodiment of FIG. 6, it is seen that serial packets are sent to the STX2 66 module. From there, the information may be sent to a satellite or other wireless system, then Via e-mail to a user portal so that appropriate further information is conveyed, including dialing a phone.

In accordance with the above, it is seen that once the invention is installed and operating, it is possible for a user to receive continuous (24 hour) automatic status information regarding the condition of the cathodic protection system and/or the testing equipment. The invention is designed to be simple and easy to install and operate. Embodiments may be provided in a convenient small size and provide needed remote independent monitoring of cathodic protection systems and testing equipment. For the user that tests the cathodic protection system itself, the cost savings are realized by avoiding having to physically verify every day that things are working. In a year, these savings could pay many times over the cost of the invention. For the user that owns or maintains the pipelines, it is an invaluable help in assuring that the pipeline structures are protected all day and night by constant monitoring. Many existing cathodic protection systems do not have remote monitoring as provided by the present invention, so if the protection system fails for any reason and the pipelines deteriorates as a result, the remedies are orders of magnitude greater than the cost of purchasing, installing and maintaining the present invention, particularly now when oil and gas resources have become expensive.

It is to be appreciated that different versions of the invention may be made from different combinations of the various features described above. It is to be understood that other variations and modifications of the present invention may be made without departing from the scope thereof. It is also to be understood that the present invention is not to be limited by the specific embodiments, illustrations or examples disclosed herein, but only in accordance with the appended claims when read in light of the foregoing specification.

What is claimed is:

1. A device for monitoring a cathodic protection system having a DC power source electrically connected to a buried structure, and a current interrupter having a first state and a second state for cyclically interrupting power provided to said structure at outputs of said DC power source, said device comprising:

a. a current input, a voltage input and a common input each electrically connected to said outputs of said DC power source;

b. an analog-to-digital converter electrically connected to at least one of said inputs and having at least one output;

c. a microprocessor electrically connected to said at least one output of said analog-to-digital converter, said microprocessor having programming adapted to asynchronously determine the state of said current interrupter; and d. a communication port for outputting data from said microprocessor, said data representative of one of the group consisting of an average voltage of said DC power source when said current interrupter has said first state, an average voltage of said DC power source when said current interrupter has said second state, an average current of said DC power source when said current interrupter has said first state, an average current of said DC power source when said current interrupter has said second state, and combinations thereof.

2. The device of claim 1 wherein said microprocessor further comprises programming adapted to identify patterns of changes in said voltage of said DC power source.

3. The device of claim 2 further comprising at least one user input for establishing at least one threshold value, wherein said microprocessor further comprises programming adapted to compare said at least one threshold value to said voltage of said DC power source and trigger an alarm if said threshold value is crossed.

4. The device of claim 1 wherein said microprocessor further comprises programming adapted to identify patterns of changes in said current of said DC power source.

5. The device of claim 4 further comprising at least one user input for establishing at least one threshold value, wherein said microprocessor further comprises programming adapted to compare said at least one threshold value to said current of said DC power source and trigger an alarm if said threshold value is crossed.

6. The device of claim 1 further comprising a current sense resistor at one of said outputs of said DC power source, wherein said current input and said common input are electrically connected to opposite sides of said current sense resistor.

7. The device of claim 1 further comprising at least one input filter and at least one amplifier between at least one of said inputs and said analog-to-digital converter.

8. The device of claim 1 wherein said communication port is connected to one of the group consisting of a satellite system, a wireless telephone system, a wireless paging system, a computer network, an internet connection, a computer system, a radio transmitter, a wired telephone system, a terminal, a display, and combinations thereof.

9. The device of claim 1 further comprising at least one battery powering said device.

10. The device of claim 1 said DC power source powering said device.

11. The device of claim 1, wherein said microprocessor further comprises programming adapted to determine the period of time that said current interrupter has one of the group consisting of said first state, said second state, and combinations thereof.

12. In combination, a cathodic protection system having a buried structure, a DC power source electrically connected to said structure, a current interrupter having a first state and a second state for cycling the output power of said DC power source, and a device for monitoring said current interrupter, said device comprising:

a. a current input, a voltage input and a common input each electrically connected to outputs of said DC power source, wherein said current input and said common input are each electrically connected to opposite sides of a current sense resistor between said DC power source and said structure;

b. at least one filter and at least one amplifier electrically connected to said inputs;

c. an analog-to-digital converter electrically connected to one of said at least one filter and said at least one amplifier, said converter having at least one output;

d. a microprocessor electrically connected to said at least one output of said analog-to-digital converter, said microprocessor having programming adapted to asynchronously determine the state of said current interrupter, the period of time that said current interrupter has said first state, and the period of time that said current interrupter has said second state, said microprocessor further having programming adapted to identify patterns of changes in output levels of said DC power source;

e. a communication port for outputting data from said microprocessor, said data representative of one of the group consisting of an average voltage of said DC power source when said current interrupter has said first state, an average voltage of said DC power source when said current interrupter has said second state, an average current of said DC power source when said current interrupter has said first state, an average current of said DC power source when said current interrupter has said second state, and combinations thereof; and f. at least one user input for establishing at least one threshold value, wherein said microprocessor further comprises programming adapted to compare said at least one threshold value to said output levels of said DC power source and trigger an alarm if said threshold value is crossed.

13. A device for monitoring the testing of a cathodic protection system comprising:

a. means for receiving analog signals from an output of a DC power source electrically connected to a buried structure, said analog signals corresponding to a current and a voltage of said DC power source;

b. means for converting said analog signals to digital signals;

c. microprocessor means receiving said digital signals for asynchronously determining from said digital signals the presence of a cycle on at least one of the group consisting of said current of said DC power source and said voltage of said DC power source; and d. means for indicating the result of said determination.

14. The device of claim 13, said cycle comprising an "on" state and an "off" state, further comprising means for determining one of the group consisting of a period of time of said "on" state, a period of time of said "off" state, and combinations thereof.

15. The device of claim 13, said cycle comprising an "on" state and an "off" state, further comprising means for determining at least one of the group consisting of an average of said current of said DC power source and an average of said voltage of said DC power source during said "on" state, said "off" state, and combinations thereof.

16. A method for monitoring a cathodic protection system comprising the steps of:

a. receiving at least one signal, said signal representative of one of the group consisting of a voltage of a DC power source electrically attached to a buried structure of said cathodic protection system and a current of said DC power source;

b. asynchronously establishing (i) an "on" condition when a first number of consecutive samples of said signal are greater than a long term average of said signal and (ii) an "off" condition when a second number of consecutive samples of said signal are less than said long term average;

c. determining the period of time between the first condition and the second condition, an average value of said signal corresponding to said first condition, and an average value of said signal corresponding to said second condition;

d. determining the presence of a cyclical pattern of said signal; and e. indicating one of the group consisting of the presence of said cyclical pattern, said average value of said signal corresponding to said first condition, said average value of said signal corresponding to said second condition, and combinations thereof.

17. The method of claim 16 further comprising receiving at least two electrical signals from the output of a DC power source, wherein a first of said signals is representative of said voltage of said DC power source and a second of said signals is representative of said current of said DC power source.

18. The method of claim 17 wherein said "on" and said "off" conditions are established corresponding to said second signal and said average values of said signal are determined corresponding to said first signal.

19. The method of claim 16 further comprising the steps of comparing samples of said signal to at least one user defined threshold, and indicating the result of said comparison.

20. The method of claim 16 further comprising the step of determining one of the group consisting of a pulse width, a cycle time, a duty cycle, and combinations thereof of said signal.

21. A method for monitoring a cathodic protection system comprising the steps of:

a. receiving a first analog signal and a second analog signal from the output of a DC power source electrically attached to said cathodic protection system, said first signal representative of a current of said DC power source and said second signal representative of a voltage of said DC power source;

b. converting said first and said second analog signals to a first and a second digital signal, respectively;

c. filtering each said digital signal to eliminate noise therefrom;

d. computing a long term average of said first digital signal;

e. establishing an "on" condition when consecutive samples of said first digital signal are greater than said long term average; and f. establishing an "off" condition when subsequent consecutive samples of said first digital signal are less than said long term average.

22. The method of claim 21, further comprising the steps of computing one of the group consisting of an average of a plurality of samples of said second digital signal corresponding to said "on" condition, an average of a plurality of samples of said second digital signal corresponding to said "off" condition, and combinations thereof.

23. The method of claim 21 further comprising the step of determining the presence of a cyclical pattern of at least one of said digital signals and indicating the results of said determination.

24. The method of claim 23 further comprising the step of computing one of the group consisting of a pulse width, a cycle time, a duty cycle, and combinations thereof of one of said first digital signal and said second digital signal.

25. A method for asynchronously determining the condition of a cycling cathodic protection system from a plurality of samples of an output of a DC power source electrically connected to a buried structure of said cathodic protection system, said method comprising the steps of:

a. computing a long term average of said samples;

b. comparing each said sample to said long term average to determine whether said sample has a magnitude that is greater than said long term average or whether said sample has a magnitude that is less than said long term average;

c. computing a first value, said first value about equal to an average of at least one of said samples having a magnitude greater than said long term average; and d. computing a second value, said second value about equal to an average of at least one of said samples having a magnitude less than said long term average.

26. The method of claim 25, further comprising the step of computing a third value, said third value about equal to one of the group consisting of a pulse width, a cycle time, and a duty cycle of said samples.

27. A device for independently and asynchronously monitoring a power source of a cathodic protection system, said power source having a first mode generating a constant power and a second mode generating a rectangular wave power, said device comprising a. a battery powered microcontroller electrically connected to at least two points of said power source for sampling of the group consisting of a voltage of said power source, a current of said power source, and combinations thereof; and b. programming adapted to determine the mode of said power source and a long term average of said voltage of said power source, and when said power source has said second mode, determine the cycle period, the duty cycle, the pulse width, an average "on" voltage value, and an average "off" voltage value of said power source.

* * * * *